US009552940B2

(12) United States Patent
Takeda

(10) Patent No.: US 9,552,940 B2
(45) Date of Patent: Jan. 24, 2017

(54) SWITCH, SWITCH ASSEMBLY AND SWITCH SEAL STRUCTURE

(71) Applicant: YAMAHA HATSUDOKI KABUSHIKI KAISHA, Iwata-shi, Shizuoka-ken (JP)

(72) Inventor: Yukio Takeda, Iwata (JP)

(73) Assignee: YAMAHA HATSUDOKI KABUSHIKI KAISHA, Iwata-shi, Shizuoka-ken (JP)

( * ) Notice: Subject to any disclaimer, the term of this patent is extended or adjusted under 35 U.S.C. 154(b) by 24 days.

(21) Appl. No.: 14/630,641

(22) Filed: Feb. 24, 2015

(65) Prior Publication Data

US 2015/0357134 A1 Dec. 10, 2015

(30) Foreign Application Priority Data

Jun. 6, 2014 (JP) ..... 2014-117921

(51) Int. Cl.
*H01H 23/24* (2006.01)
*H01H 23/06* (2006.01)
*H01H 23/12* (2006.01)

(52) U.S. Cl.
CPC ..... *H01H 23/24* (2013.01); *H01H 23/06* (2013.01); *H01H 23/12* (2013.01); *H01H 2231/026* (2013.01)

(58) Field of Classification Search
CPC .. H01H 23/24; H01H 2231/026; H01H 23/12; H01H 23/06
USPC . 200/61.54, 341, 314, 51 R, 51.07; 439/188, 439/271–272
See application file for complete search history.

(56) References Cited

U.S. PATENT DOCUMENTS 5,434,375 A * 7/1995 Kawada ..... H01H 11/0031 200/51 R
6,955,552 B2 * 10/2005 Ferri ..... H01R 33/945 200/51.09
8,044,313 B2 * 10/2011 Yamamoto ..... B62K 11/14 200/314

FOREIGN PATENT DOCUMENTS

JP H03-118294 A 5/1991

* cited by examiner

*Primary Examiner* — Edwin A. Leon
(74) *Attorney, Agent, or Firm* — Rabin & Berdo, P.C.

(57) ABSTRACT

Provided is a switch attached to an attachment object through a seal member. The switch includes an operating portion including an operating surface. The switch further includes a support portion supporting the operating portion to enable a push operation for the operating portion. The switch further includes a flange portion disposed in a direction of the push operation relative to the support portion. The switch further includes a seal holding portion disposed in the direction of the push operation relative to the flange portion. The seal holding portion has a circular shaped portion or an oval shaped portion in contact with the seal member to hold the seal member with the circular shaped portion or the oval shaped portion. The switch further includes a pawl portion disposed in the direction of the push operation relative to the seal holding portion and configured to be hooked to the attachment object.

20 Claims, 21 Drawing Sheets

PRIOR ART

PRIOR ART

SWITCH, SWITCH ASSEMBLY AND SWITCH SEAL STRUCTURE

CROSS-REFERENCE TO RELATED APPLICATIONS

This application claims priority to Japanese Patent Application No. 2014-117921 filed on Jun. 6, 2014, the entirety of which is hereby incorporated by reference in its entirety.

BACKGROUND OF THE INVENTION

1. Field of the Invention

The present invention relates to a switch, a switch assembly and a switch seal structure.

2. Description of the Related Art

A water vehicle is provided with various types of switches. For example, a PTT switch is configured to be operated for adjusting the tilt and trim angles of an outboard motor. The PTT switches are attached to a plurality of positions such as an outboard motor body, a tiller handle, a remote controller and so forth.

When a given one of the switches is designed to be attached to a position with low necessity for waterproofing, attaching the switch to the position is performed with a simple construction as described in, for instance, Japan Laid-open Patent Application Publication No. JP-A-H03-118294. The switch described in the Publication No. JP-A-H03-118294 includes an elastic pawl having a roughly rectangular shape, whereas a grip of an operating handle includes a stepped portion. The elastic pawl is locked with the stepped portion, and thus, the switch is fixed to the operating handle.

SUMMARY OF THE INVENTION

The construction described in the Publication No. JP-A-H03-118294 enables the switch to be easily attached to the operating handle, but does not have waterproofing properties. For example, the switch described in the Publication No. JP-A-H03-118294 includes a seal structure formed along a roughly rectangular flange shape. In this type of seal structure, a seal member cannot fit to the corners of the rectangular flange in a good condition. Thus, the sealing properties of the seal member degrade in the corners, and the seal structure cannot exert sufficient waterproofing properties.

Incidentally, with advances in precision of the internal structures of switches, waterproofing has been increasingly demanded even for the aforementioned type of switch from the perspective of erosion prevention. By contrast, another type of switch, which has been so far attached to a position with high necessity for waterproofing (e.g., an outboard motor body), employs a construction different from that employed by the aforementioned type of switch in order to reliably achieve required sealing properties. For example, as shown in FIGS. 20 and 21, a switch 101 is fixed to an outboard motor body 103 so as to be pressed onto an O-ring 104 from the inside of the outboard motor body 103 by a bracket 102 made of sheet metal. However, the attachment structure including the bracket 102 thus having a large size includes a drawback of increase in cost, weight or layout space.

It is an object of the present invention to provide a switch that can exert better sealing properties with a simple construction.

A switch according to a first aspect is attached to an attachment object through a seal member. The switch includes an operating portion, a support portion, a flange portion, a seal holding portion and a pawl portion. The operating portion includes an operating surface. The support portion supports the operating portion so as to enable a push operation for the operating portion. The flange portion is disposed so as to enclose a surrounding of the support portion. Additionally, a projected area of the flange portion is larger than the operating portion. The seal holding portion is disposed in a direction of the push operation to the flange portion. As used herein, the direction of the push operation (which may also be referred to as a pushing direction") may mean the direction a user pushes or actuates the operating portion during the pushing operation. Additionally, the seal holding portion includes a circular or oval portion making contact with the seal member. Besides, the seal holding portion circularly or ovally holds the seal member. The pawl portion is disposed in the direction of the push operation to the seal holding portion. Additionally, the pawl portion is configured to be hooked to the attachment object.

A switch assembly according to a second aspect includes a seal member and a switch. The switch is attached to an attachment object through the seal member. Additionally, the switch includes an operating portion, a support portion, a flange portion, a seal holding portion and a pawl portion. The operating portion includes an operating surface. The support portion supports the operating portion so as to enable a push operation for the operating portion. The flange portion is disposed so as to enclose a surrounding of the support portion. Additionally, a projected area of the flange portion is larger than the operating portion. The seal holding portion is disposed in a direction of the push operation to the flange portion. Additionally, the seal holding portion includes a circular or oval portion making contact with the seal member. Besides, the seal holding portion circularly or ovally holds the seal member. The pawl portion is disposed in the direction of the push operation to the seal holding portion. Additionally, the pawl portion is configured to be hooked to the attachment object.

A switch seal structure according to a third aspect includes a seal member, an attachment object and a switch. The switch is attached to the attachment object through the seal member. The switch includes an operating portion, a support portion, a flange portion, a seal holding portion and a pawl portion. The operating portion includes an operating surface. The support portion supports the operating portion so as to enable a push operation for the operating portion. The flange portion is disposed so as to enclose a surrounding of the support portion. Additionally, a projected area of the flange portion is larger than the operating portion. The seal holding portion is disposed in the direction of the push operation to the flange portion. Additionally, the seal holding portion includes a circular or oval portion making contact with the seal member. Besides, the seal holding portion circularly or ovally holds the seal member. The pawl portion is disposed in the direction of the push operation to the seal holding portion. Additionally, the pawl portion is configured to be hooked to the attachment object.

In the switch related to each of the first to third aspects, the seal holding portion has a circular or oval shape. Thus, the seal member can better fit to the seal holding portion in a position corresponding to a corner of the seal holding portion. Accordingly, better sealing properties can be exerted in the first to third aspects.

Further, the seal holding portion is disposed in the direction of the push operation to the flange portion, and the pawl portion designed to be hooked to the attachment object is disposed in the direction of the push operation to the seal holding portion. With the construction, the seal member is held between the flange portion and the attachment object. Hence, when the push operation is performed, operating load acts on the flange portion in a direction of pressing the seal member toward the attachment object. Degradation in sealing properties can be thereby prevented.

Yet further, when the push operation is performed, the operating load is received by the flange portion. With the construction, the operating load can be inhibited from acting on the pawl portion. Accordingly, detachment of the switch can be prevented.

BRIEF DESCRIPTION OF THE DRAWINGS

Referring now to the attached drawings which form a portion of this original disclosure.

DETAILED DESCRIPTION OF THE PREFERRED EMBODIMENTS

Preferred embodiments of the present invention will be hereinafter explained with reference to the attached drawings.

Figure 1:
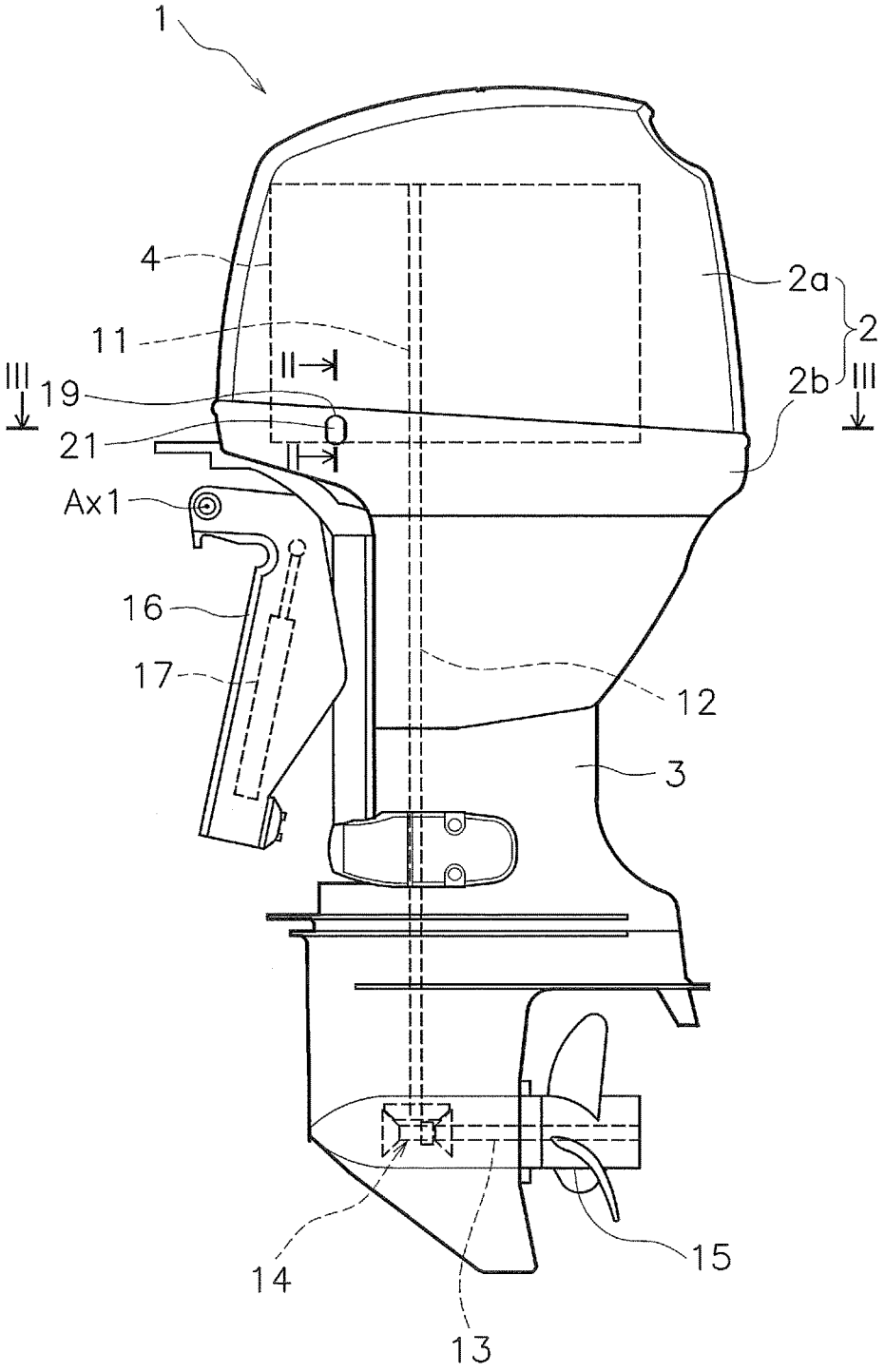
FIG. 1 is a side view of an outboard motor according to a first preferred embodiment.

FIG. 1 is a side view of an outboard motor 1 according to a first preferred embodiment. The outboard motor 1 includes an engine cover 2, a casing 3 and an engine 4. The engine cover 2 accommodates the engine 4. The engine cover 2 includes an upper cover 2*a* and a lower cover 2*b*. The upper cover 2*a* is disposed over the lower cover 2*b*. The upper cover 2*a* is attached to the lower cover 2*b*. The casing 3 is disposed under the engine cover 2.

The engine 4 is disposed inside the engine cover 2. The engine 4 includes a crankshaft 11 extending in the up-and-down direction. A driveshaft 12 is disposed inside the casing 3 and extends in the up-and-down direction. The driveshaft 12 is coupled to the crankshaft 11.

A propeller shaft 13 is disposed in the lower portion of the casing 3. The propeller shaft 13 extends in the back-and-forth direction. The propeller shaft 13 is coupled to the lower portion of the driveshaft 12 through a shift mechanism 14. The propeller shaft 13 is connected to a propeller 15. The shift mechanism 14 is configured to transmit rotational driving force of the driveshaft 12 to the propeller shaft 13. Further, the shift mechanism 14 is configured to switch the rotational direction of the driving force to be transmitted from the driveshaft 12 to the propeller shaft 13.

In the outboard motor 1, driving force generated by the engine 4 is transmitted to the propeller 15 through the driveshaft 12, the shift mechanism 14 and the propeller shaft 13. Thus, the propeller 15 is configured to be forwardly or reversely rotated. This results in generation of thrust for forwardly or backwardly moving a hull to which the outboard motor 1 is attached.

The outboard motor 1 includes a bracket 16 and a PTT (Power Tilt and Trim) device 17. The outboard motor 1 is attached to the hull through the bracket 16. The outboard motor 1 is attached to the hull so as to be capable of pivoting up and down about a tilt axis Ax1 of the bracket 16. The tilt axis Ax1 extends in the right-and-left direction. For example, the PTT device 17 includes a hydraulic or electric cylinder. Alternatively, the PTT device 17 may include a hydraulic or electric motor. The PTT device 17 causes the outboard motor 1 to pivot about the tilt axis Ax1.

The outboard motor 1 includes a PTT switch 21. The PTT switch 21 is a type of switch for performing tilt and trim operations of the outboard motor 1. The PTT device 17 is configured to be driven by the operation of the PTT switch 21. The PTT switch 21 is attached to the engine cover 2. When described in detail, the PTT switch 21 is attached to the lower cover 2*b*. A switch seal structure for attaching the PTT switch 21 to the engine cover 2 will be hereinafter explained.

Figure 2:
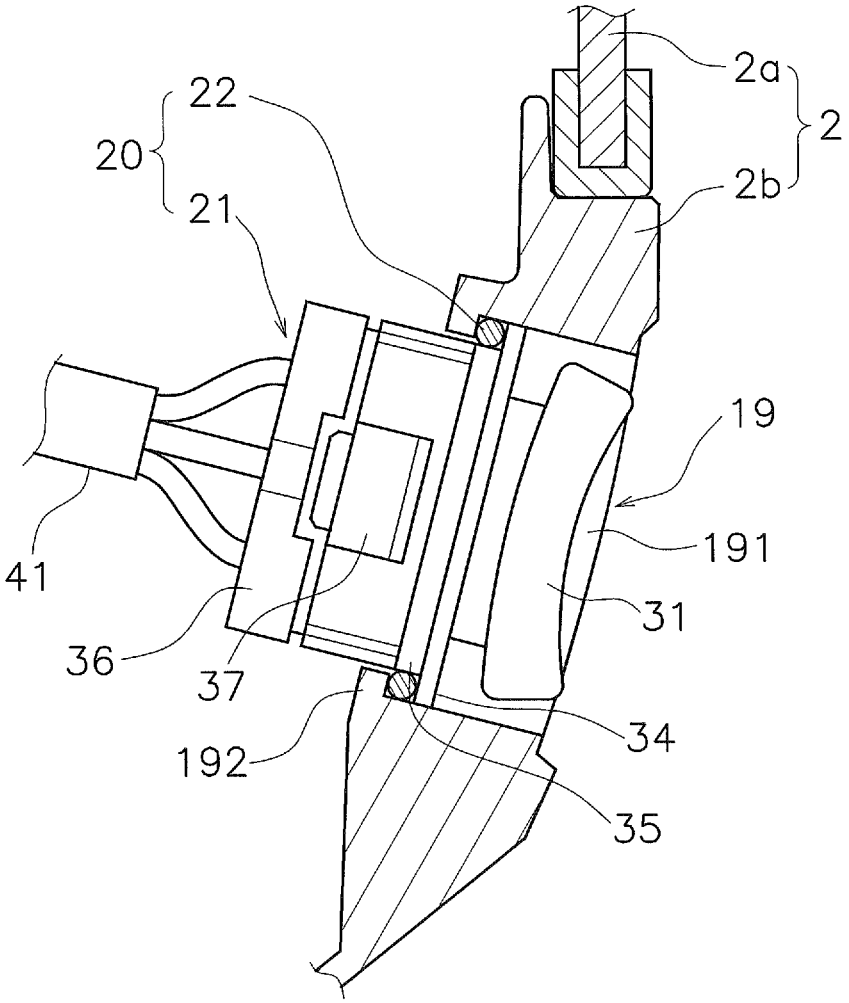
FIG. 2 is a diagram partially showing a cross-section II-II in FIG. 1.
Figure 3:
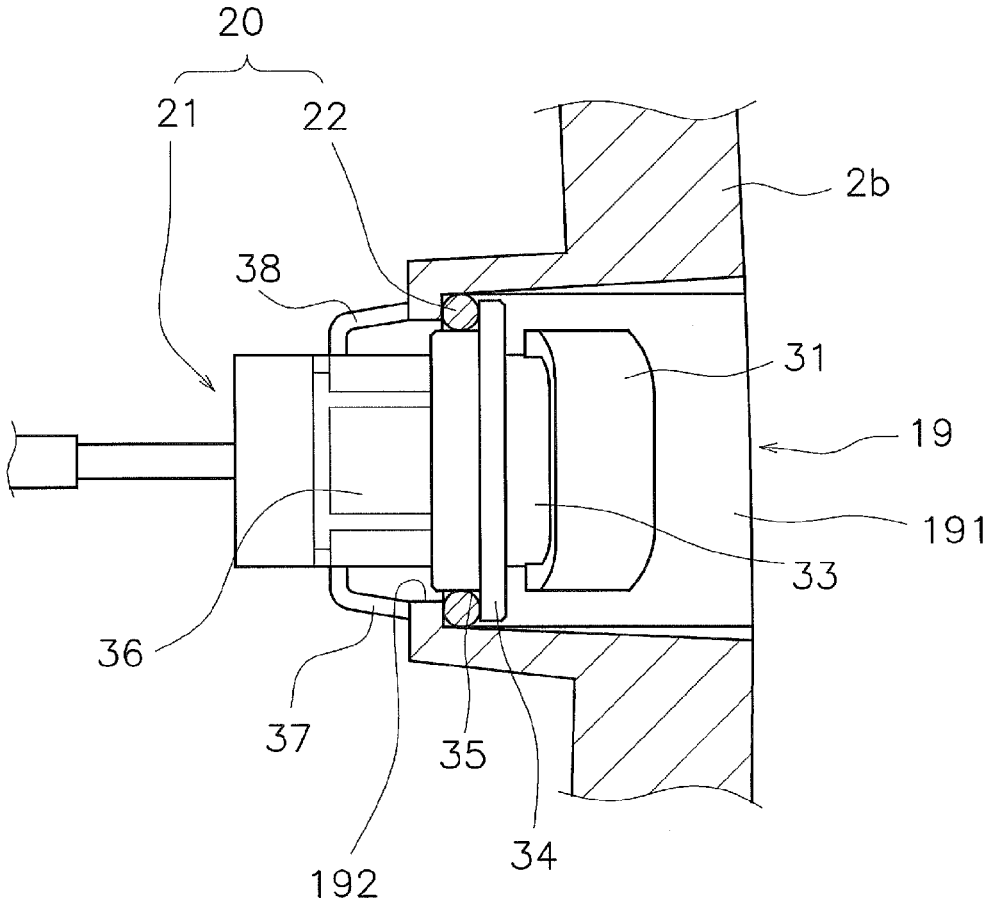
FIG. 3 is a diagram partially showing a cross-section III-III in FIG. 1.

FIG. 2 is a diagram of the switch seal structure taken along a cross-section II-II in FIG. 1. FIG. 3 is a diagram of the switch seal structure taken along a cross-section III-III in FIG. 1. As shown in FIGS. 2 and 3, the switch seal structure includes a switch attached portion 19 and a switch assembly 20. The switch attached portion 19 is a portion of the engine cover 2. When described in detail, the switch attached portion 19 is provided for the lower cover 2*b*. The outer surface of the switch attached portion 19 includes an aperture 191 to which the PTT switch 21 is attached.

Figure 4:
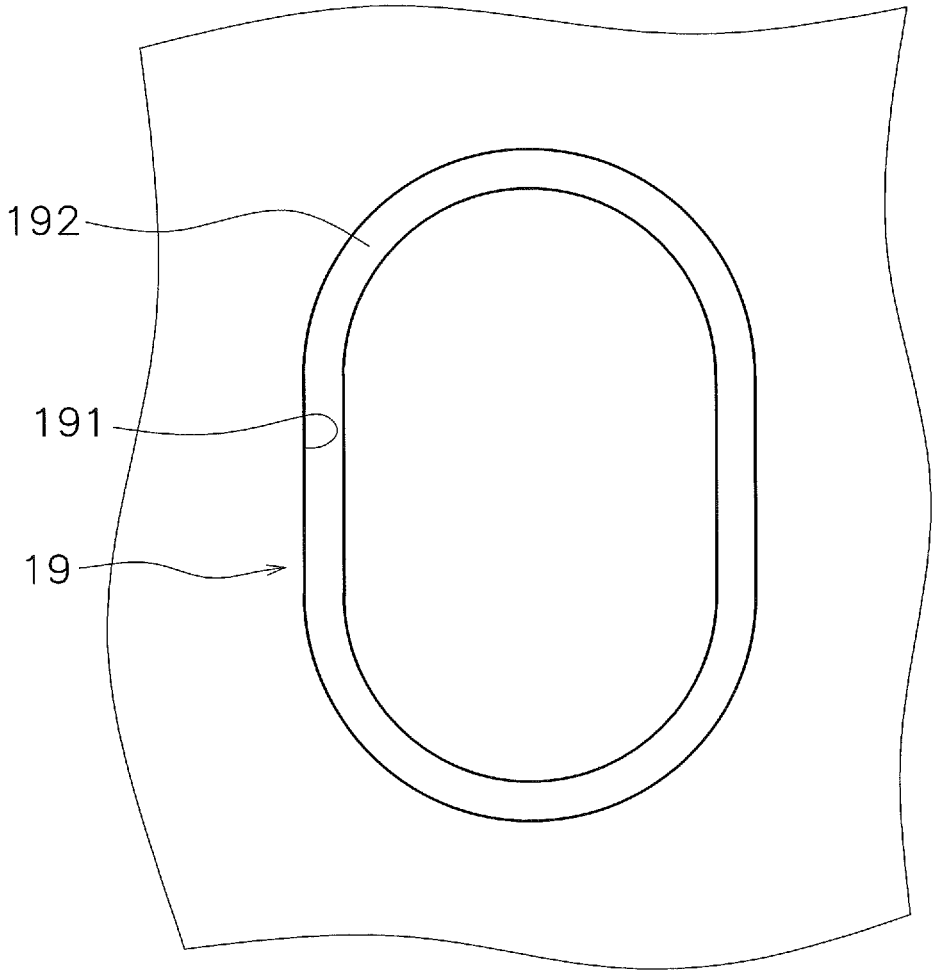
FIG. 4 is an enlarged view of a switch attached portion.

FIG. 4 is an enlarged view of the switch attached portion 19. It should be noted that FIG. 4 shows a condition that the PTT switch 21 is detached from the switch attached portion 19. As shown in FIG. 4, the aperture 191 has an oval shape. The switch attached portion 19 includes an attachment flange 192. As shown in FIGS. 2 and 3, the attachment flange 192 protrudes from the inner surface of the aperture 191. Similarly to the aperture 191, the attachment flange 192 has an oval shape.

Figure 5:
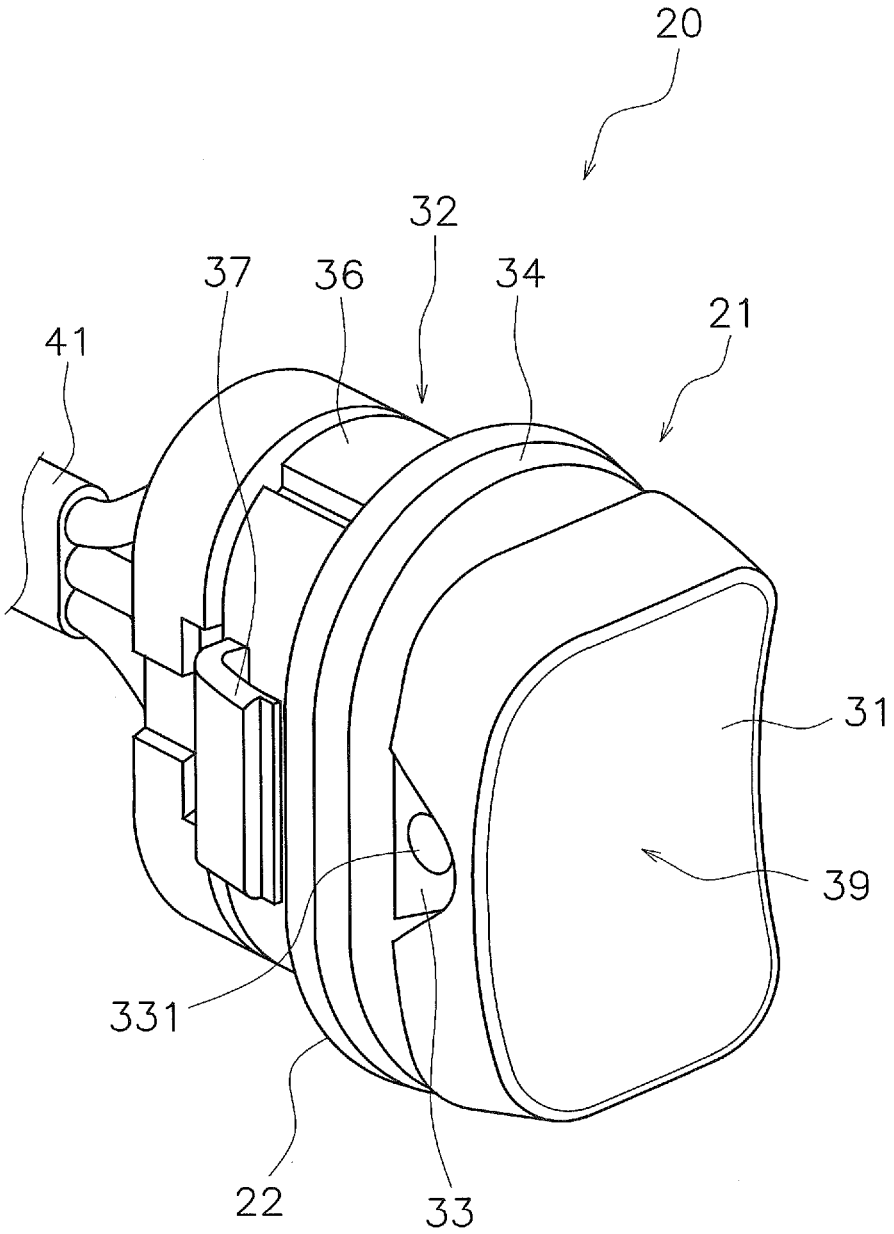
FIG. 5 is a perspective view of a switch assembly.
Figure 6:
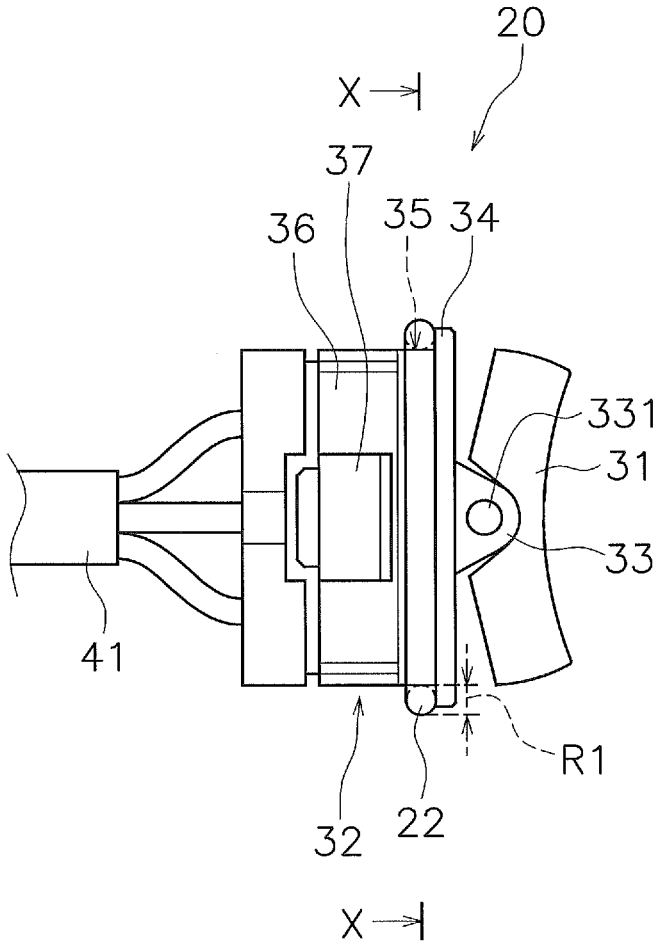
FIG. 6 is a side view of the switch assembly.
Figure 7:
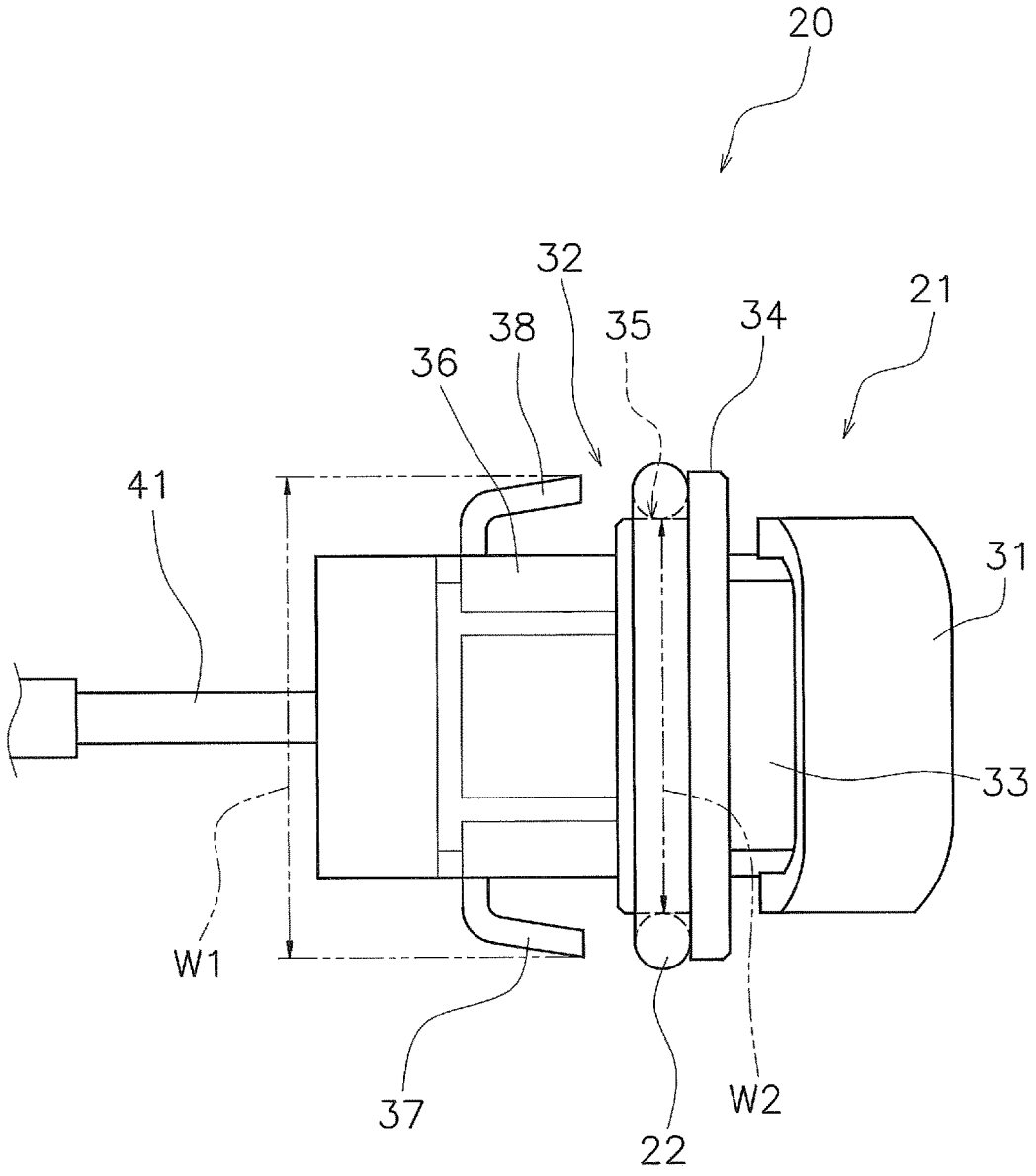
FIG. 7 is a plan view of the switch assembly.
Figure 8:
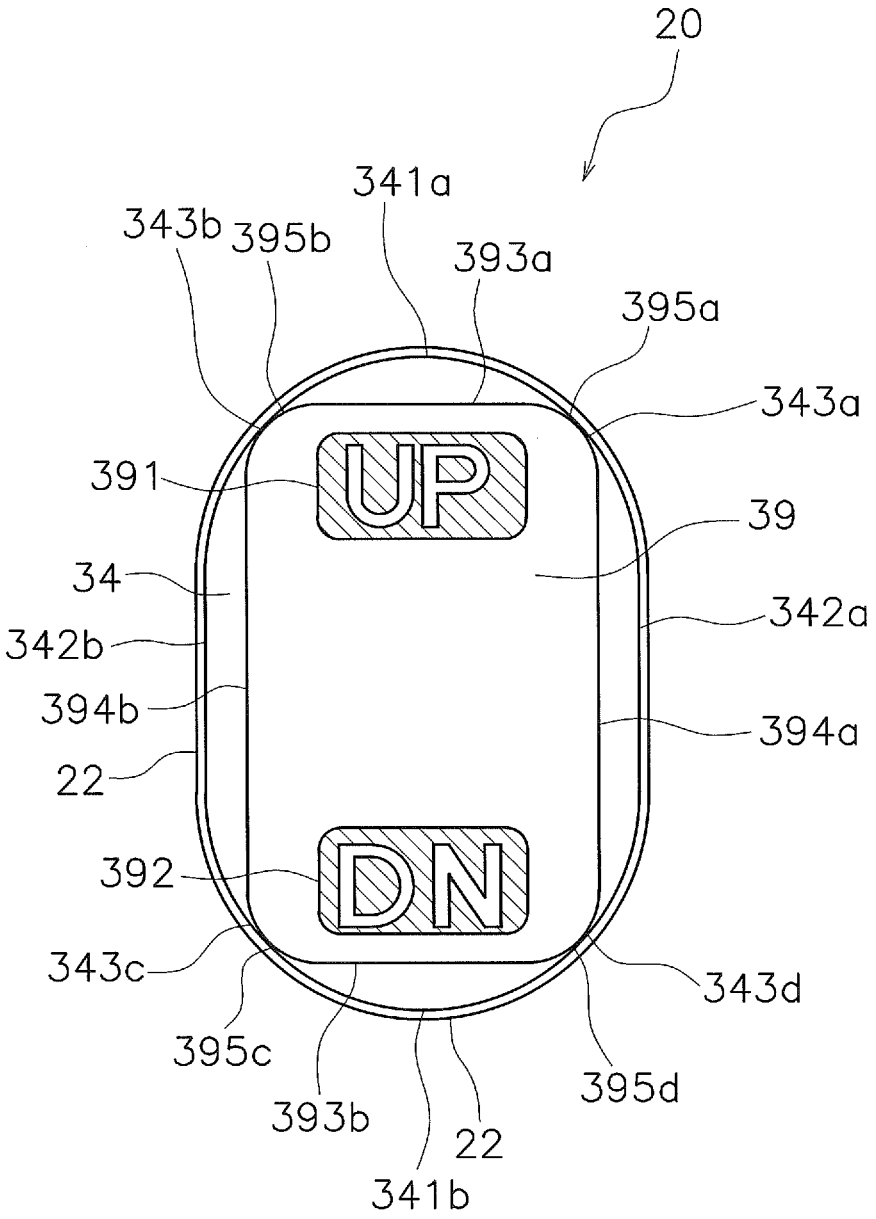
FIG. 8 is a front view of the switch assembly.
Figure 9:
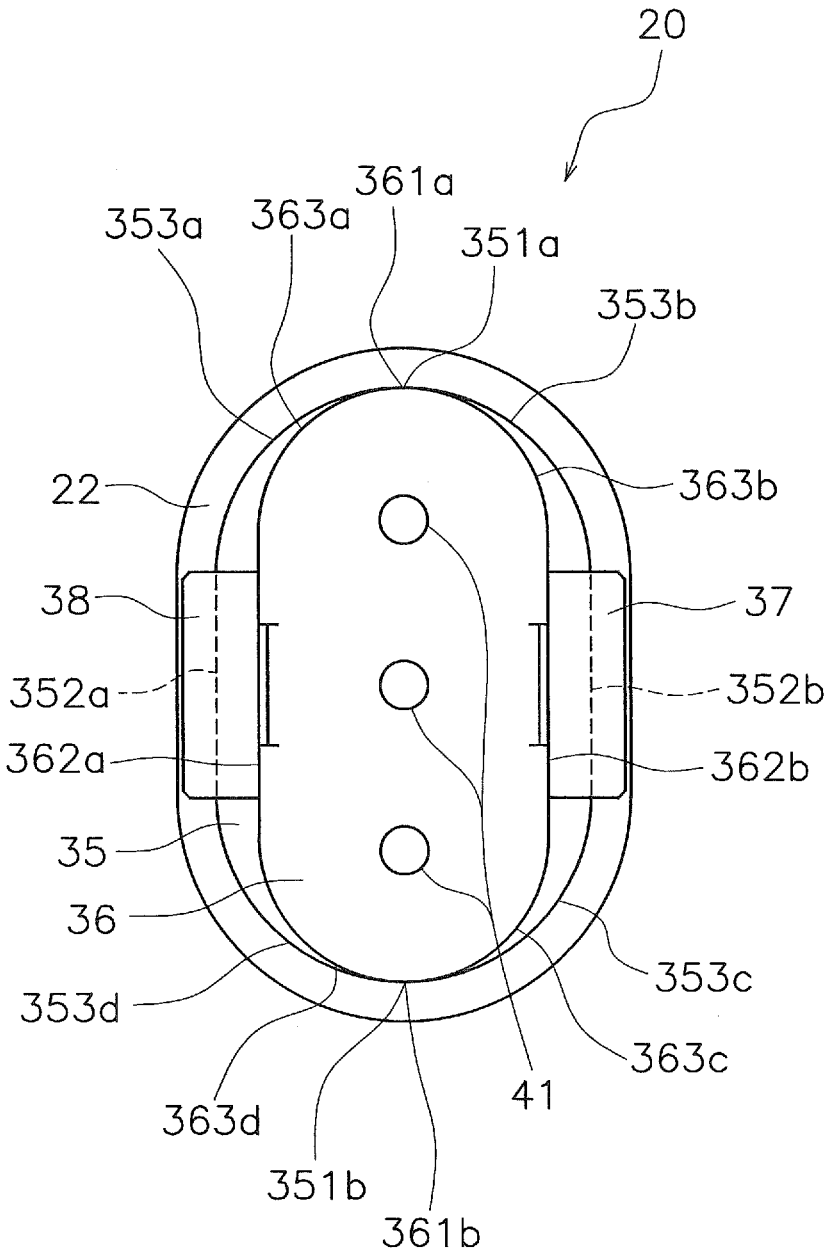
FIG. 9 is a rear view of the switch assembly.

FIG. 5 is a perspective view of the switch assembly 20. FIG. 6 is a side view of the switch assembly 20. FIG. 7 is a plan view of the switch assembly 20. FIG. 8 is a front view of the switch assembly 20. FIG. 9 is a rear view of the switch assembly 20. It should be noted that for convenience, the term "front view" is defined as a view from a direction of performing a push operation of the PTT switch 21, and on the basis of this, the terms "side view", "plan view" and "rear view" are respectively defined. Further, these terms are not intended to limit the directions of the switch assembly 20.

The switch assembly 20 includes the PTT switch 21 and a seal member 22. The PTT switch 21 is attached to the switch attached portion 19 through the seal member 22. The PTT switch 21 includes an operating portion 31 and an attachment member 32. The operating portion 31 is supported by the attachment member 32. The attachment member 32 is attached to the switch attached portion 19. The attachment member 32 includes a support portion 33, a flange portion 34, a seal holding portion 35, a body 36 and pawl portions 37 and 38.

The support portion 33 supports the operating portion 31 so as to enable a push operation of the operating portion 31. The operating portion 31 includes an operating surface 39. As shown in FIG. 8, the operating surface 39 includes a first operating position 391 and a second operating position 392. For example, the push operation is performed for the first operating position 391 when an "UP" operation is performed for the PTT device 17. On the other hand, the push operation is performed for the second operating position 392 when a "DOWN" operation is performed for the PTT device 17. The operating portion 31 is supported by the support portion 33 so as to be capable of pivoting about a pivot center 331 located between the first operating position 391 and the second operating position 392.

The flange portion 34 is disposed so as to enclose the surrounding of the support portion 33. That is, the flange portion 34 disposed in a direction of the push operation relative to all of the support portion 33 so that the flange portion 34 is underneath all of the support portion 33. The flange portion 34 is disposed in the direction of the push operation to the support portion 33. The flange portion 34 is located between the support portion 33 and the seal holding portion 35. The flange portion 34 has a shape protruding from the seal holding portion 35 in a direction oriented perpendicularly to the direction of the push operation.

As shown in FIG. 8, the flange portion 34 has an oval shape. Likewise, the operating surface 39 also has an oval shape. A projected area of the flange portion 34 to a direction oriented perpendicularly to a plane on which the flange portion 34 is arranged is larger than the operating portion 31.

It should be noted that the attachment direction of the PTT switch 21 is substantially the same as the direction oriented perpendicularly to the plane on which the flange portion 34 is arranged. The direction of the push operation is substantially the same as the direction oriented perpendicularly to the plane on which the flange portion 34 is arranged.

The oval shape of the operating surface 39 includes a pair of short sides 393*a* and 393*b*, a pair of long sides 394*a* and 394*b* and rounded corners 395*a* to 395*d*. On the other hand, the oval shape of the flange portion 34 includes a pair of short sides 341*a* and 341*b*, a pair of long sides 342*a* and 342*b* and rounded corners 343*a* to 343*d*. It should be noted that the terms "short side" and "long side" herein refer to straight portions.

It should be noted that the length of the short side 341*a* of the flange portion 34 is roughly zero, and thus, the short side 341*a* and the rounded corners 343*a* and 343*b* form a roughly semicircular shape. Likewise, the length of the short side 341*b* of the flange portion 34 is roughly zero, and thus, the short side 341*b* and the rounded corners 343*c* and 343*d* form a roughly semicircular shape. When seen from the direction of the push operation, the rounded corners 395*a* to 395*d* of the operating surface 39 are partially matched with the rounded corners 343*a* to 343*d* of the flange portion 34.

Figure 10:
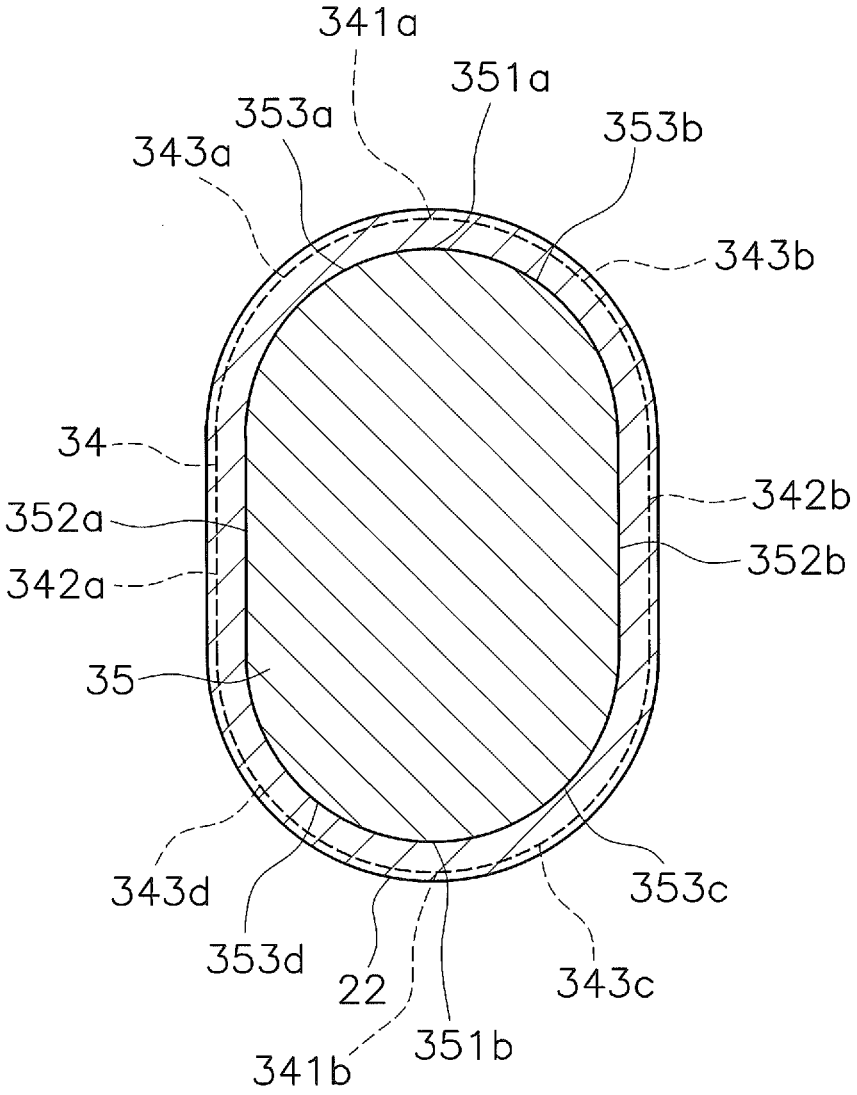
FIG. 10 is a diagram showing a cross-section X-X in FIG. 6.

As shown in FIGS. 6 and 7, the seal holding portion 35 is disposed in the direction of the push operation to the flange portion 34. FIG. 10 is a diagram showing a cross-section X-X in FIG. 6. As shown in FIG. 10, a portion of the seal holding portion 35, making contact with the seal member 22, has an oval shape. The seal holding portion 35 ovally holds the seal member 22. The oval shape of the seal holding portion 35 includes a pair of short sides 351*a* and 351*b*, a pair of long sides 352*a* and 352*b*, and rounded corners 353*a* to 353*d*. The curvature radius of each rounded corner 353*a*, 353*b*, 353*c*, 353*d* is greater than the length of each short side 351*a*, 351*b*. When described in detail, the length of each short side 351*a*, 353*b* of the seal holding portion 35 is roughly zero. Thus, the short side 351*a* and the rounded corners 353*a* and 353*b* form a roughly semicircular shape. Likewise, the short side 351*b* and the rounded corners 353*c* and 353*d* form a roughly semicircular shape.

The curvature radius of each corner 353*a*, 353*b*, 353*c*, 353*d* is greater than or equal to twice the cross-sectional diameter of the seal member 22 (see R1 in FIG. 6). The oval shape of the seal holding portion 35 and that of the flange portion 34 are similar to each other. The projected area of the flange portion 34 is larger than the seal holding portion 35.

The body 36 is disposed in the direction of the push operation to the seal holding portion 35. An electric cable 41 extends from the body 36. As shown in FIG. 9, the body 36 has an oval shape. When described in detail, the body 36 includes a pair of short sides 361*a* and 361*b*, a pair of long sides 362*a* and 362*b* and rounded corners 363*a* to 363*d*. It should be noted that the length of each short side 361*a*, 361*b* of the body 36 is roughly zero. Thus, the short side 361*a* and the rounded corners 363*a* and 363*b* form a roughly semicircular shape. Likewise, the short side 361*b* and the rounded corners 363*c* and 363*d* form a roughly semicircular shape.

The minor (shorter) axial width of the body 36 is smaller than that of the seal holding portion 35. The major (longer) axial width of the body 36 is the same as that of the seal holding portion 35. When seen from the direction of the push operation, the short sides 361*a* and 361*b* of the body 36 are respectively matched with the short sides 351*a* and 351*b* of the seal holding portion 35.

The pawl portions 37 and 38 are disposed in the direction of the push operation to the seal holding portion 35. The pawl portions 37 and 38 are designed to be hooked to the switch attached portion 19. The pawl portions 37 and 38 include a first pawl portion 37 and a second pawl portion 38. The first pawl portion 37 is connected to one of the lateral surfaces of the body 36, i.e., a lateral surface forming the long side 362*b* (hereinafter referred to as "a first lateral surface 362*b*"). The first pawl portion 37 protrudes from the first lateral surface 362*b*. On the other hand, the second pawl portion 38 is connected to another of the lateral surfaces of the body 36, i.e., a lateral surface forming the long side 362*a* (hereinafter referred to as "a second lateral surface 362*a*"). The second pawl portion 38 protrudes from the second lateral surface 362*a*. The first pawl portion 37 and the second pawl portion 38 are hooked to the attachment flange 192.

The seal member 22 is disposed between the seal holding portion 35 and the outer surface of the switch attached portion 19. In the present preferred embodiment, the seal member 22 is an O-ring. The seal member 22 is made of, for instance, an elastic material such as rubber. It should be noted that the seal member 22 may take a form other than the O-ring. Further or alternatively, the seal member 22 may be made of a material other than the elastic material.

The seal member 22 seals between the seal holding portion 35 and the outer surface of the switch attached portion 19 in the circumferential direction of the seal holding portion 35. As shown in FIG. 8, the seal member 22 outwardly protrudes from the flange portion 34 in a view from the direction of the push operation.

As shown in FIG. 7, in the minor axial direction of the seal holding portion 35, the width (W1) between the tip of the first pawl portion 37 and that of the second pawl portion 38 is larger than the width (W2) of the seal holding portion 35. The seal member 22 is disposed between the flange portion 34 and the tip of the first pawl portion 37. The seal member 22 is also disposed between the flange portion 34 and the tip of the second pawl portion 38. Thus, the seal member 22 is retained by the pawl portions 37 and 38. Due to the construction, the PTT switch 21 and the seal member 22 are unitized as the switch assembly 20.

Next, a method of attaching the switch assembly 20 according to the present preferred embodiment will be explained. The switch assembly 20 is inserted into the aperture 191 of the switch attached portion 19 from the outside of the engine cover 2. In the insertion of the switch assembly 20 into the aperture 191, the pawl portions 37 and 38 pass through the attachment flange 192 while elastically deforming. As a result, the pawl portions 37 and 38 are hooked to the attachment flange 192 in the inside of the engine cover 2. The switch assembly 20 is thereby prevented from being detached from the switch attached portion 19. Further, the seal member 22 herein makes contact with the seal holding portion 35 and the inner surface of the aperture 191. A gap between the PTT switch 21 and the switch attached portion 19 is thereby sealed.

In the aforementioned switch assembly 20 according to the present preferred embodiment, the seal holding portion 35 has an oval shape. With the construction, the seal member 22 can better fit to the seal holding portion 35 in the positions corresponding to the corners 353*a* to 353*d*. Thus, sealing properties can be improved.

Further, the seal holding portion 35 is disposed in the direction of the push operation to the flange portion 34, whereas the pawl portions 37 and 38 are disposed in the direction of the push operation to the seal holding portion 35. With the construction, the seal member 22 is held between the flange portion 34 and the attachment flange 192 as shown in FIGS. 2 and 3. Hence, when the push operation is performed, operating load acts on the flange portion 34 in the direction of pressing the seal member 22 toward the attachment flange 192. Thus, degradation in sealing properties can be prevented.

Yet further, when the push operation is performed, the operating load is received by the flange portion 34. Therefore, the operating load can be inhibited from acting on the pawl portions 37 and 38. As a result, detachment of the PTT switch 21 can be prevented.

Figure 20:
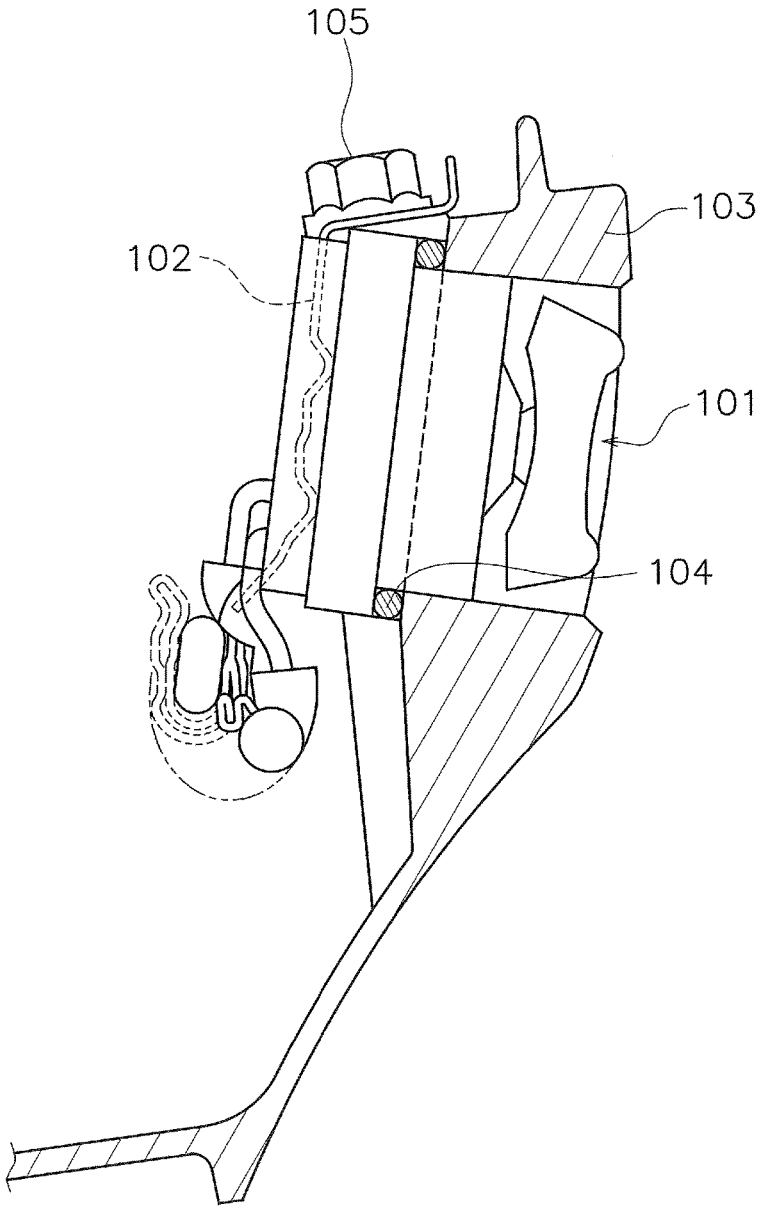
FIG. 20 is a cross-sectional view of a switch seal structure according to a related art.
Figure 21:
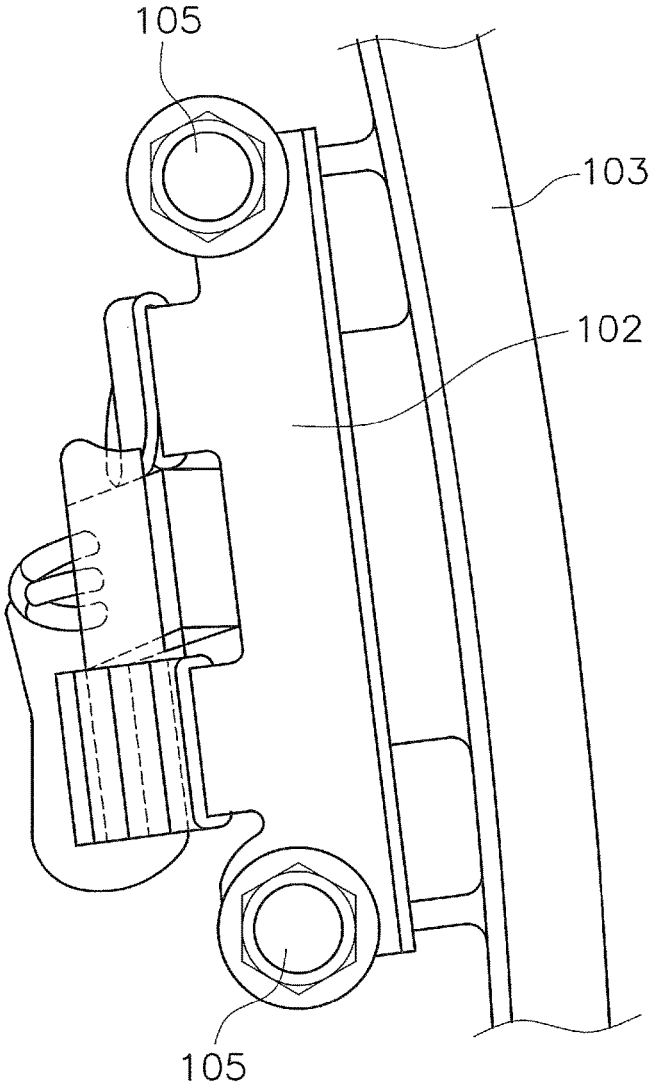
FIG. 21 is a plan view of the switch seal structure according to the related art.

The operating load is thus received by the flange portion 34. Hence, it is not required to provide the large bracket 102 and bolts 105 for fixing the bracket 102 as shown in FIGS. 20 and 21. This leads to cost reduction and weight reduction. Further, restrictions on layout in the surrounding of the PTT switch 21 can be lessened. Hence, members can be easily disposed in the surrounding of the PTT switch 21. For example, the electric cable 41 extending from the PTT switch 21 can be easily installed. Yet further, when the upper cover 2*a* is attached to the lower cover 2*b*, obstruction to the switch assembly 20 can be avoided. Hence, the upper cover 2*a* can be easily attached to the lower cover 2*b*.

As described above, in the present preferred embodiment, better sealing properties can be achieved with a simple construction.

One preferred embodiment of the present invention has been explained above. However, the present invention is not limited to the aforementioned preferred embodiment, and a variety of changes can be made without departing from the scope of the present invention.

The number of operating positions on the operating surface is not limited to two, and may be one. Alternatively, the number of operating positions on the operating surface may be more than two.

Figure 11:
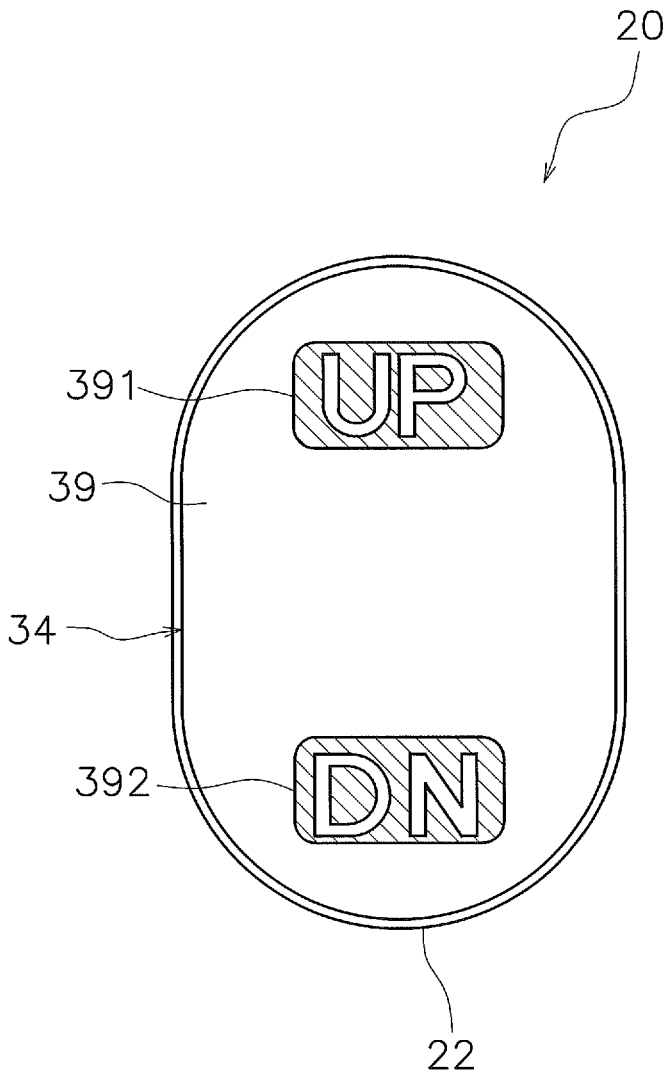
FIG. 11 is a diagram showing a switch assembly according to a first modification.

The shape of the operating surface is not limited to that described in the aforementioned preferred embodiment, and may be changed. For example, in the aforementioned preferred embodiment, the shape of the operating surface 39 is different from that of the flange portion 34 in the view from the direction of the push operation. However, as shown in a first modification of FIG. 11, the shape of the operating surface 39 may be the same as that of the flange portion 34 in the view from the direction of the push operation.

Figure 12:
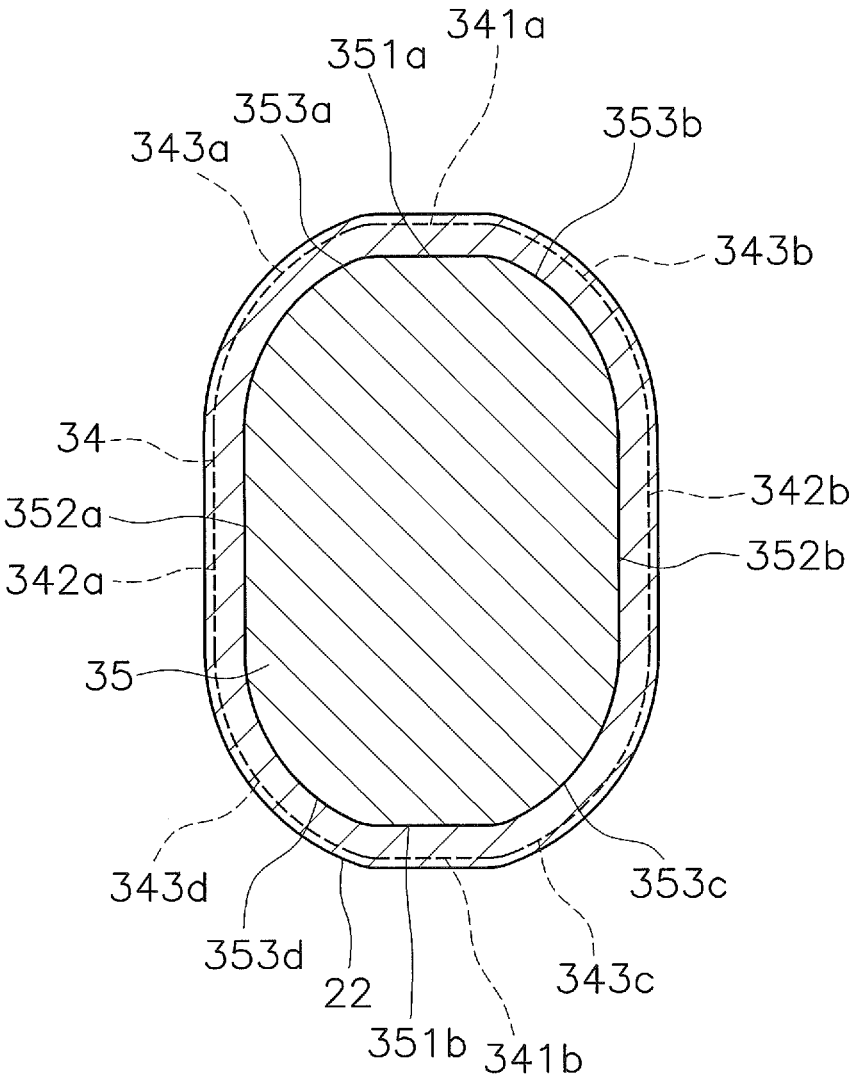
FIG. 12 is a diagram showing a switch assembly according to a second modification.

The shape of the seal holding portion 35 or that of the flange portion 34 is not limited to that described in the aforementioned preferred embodiment, and may be changed. For example, in the aforementioned preferred embodiment, each short side 351*a*, 351*b* of the seal holding portion 35 includes a length of roughly zero, and thus, hardly includes a liner portion. However, as shown in a second modification of FIG. 12, each short side 351*a*, 351*b* may include a liner portion. Further, each short side 341*a*, 341*b* of the flange portion 34 may include a liner portion.

Figure 13:
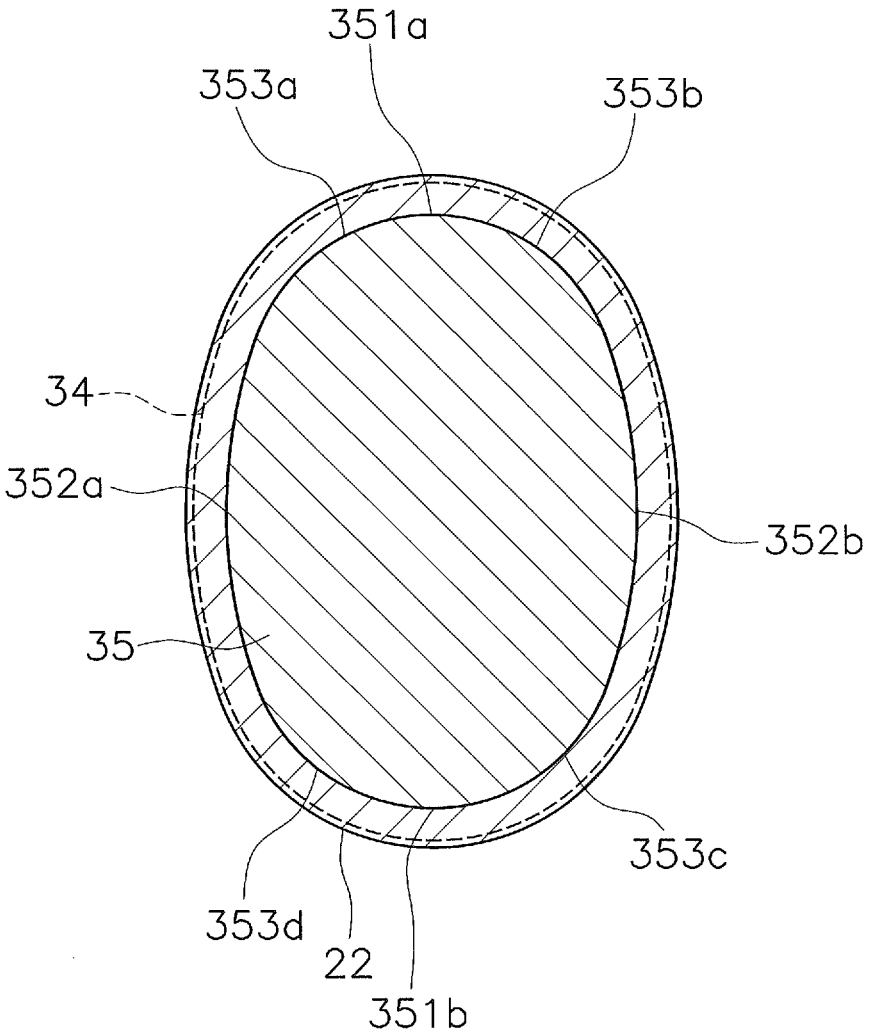
FIG. 13 is a diagram showing a switch assembly according to a third modification.

Alternatively, as shown in a third modification of FIG. 13, the seal holding portion 35 may have an oval shape that the length of each short side 351*a*, 351*b* and that of each long side 352*a*, 352*b* are both roughly zero. In other words, the oval shape of the seal holding portion 35 may be an ellipse without any liner portion. Further, the flange portion 34 may have an oval shape that the length of each short side 341*a*, 341*b* and that of each long side 342*a*, 342*b* are both roughly zero. In other words, the oval shape of the flange portion 34 may be an ellipse without any liner portion.

Figure 14:
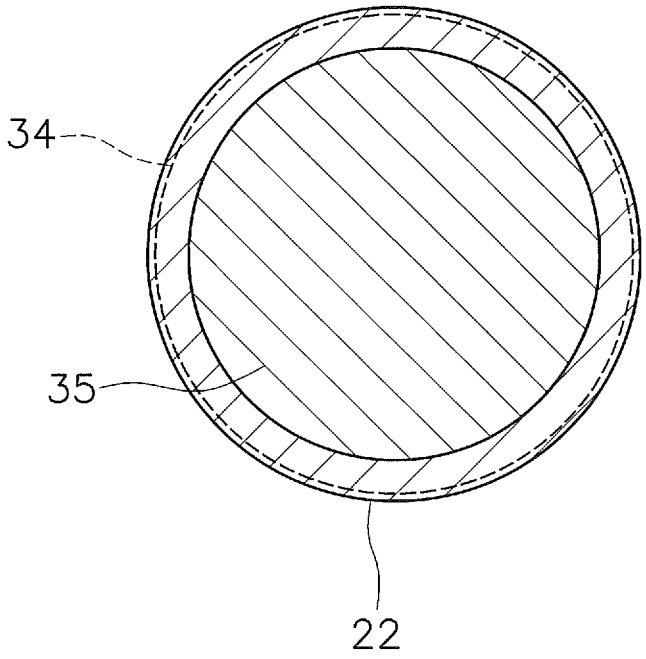
FIG. 14 is a diagram showing a switch assembly according to a fourth modification.

Yet alternatively, as shown in a fourth modification of FIG. 14, the seal holding portion 35 may have a circular shape. Further, the flange portion 34 may have a circular shape. The seal member 22 is herein circularly supported by the seal holding portion 35. Additionally, it is preferable that the aperture 191 of the switch attached portion 19 also has a circular shape.

Figure 15:
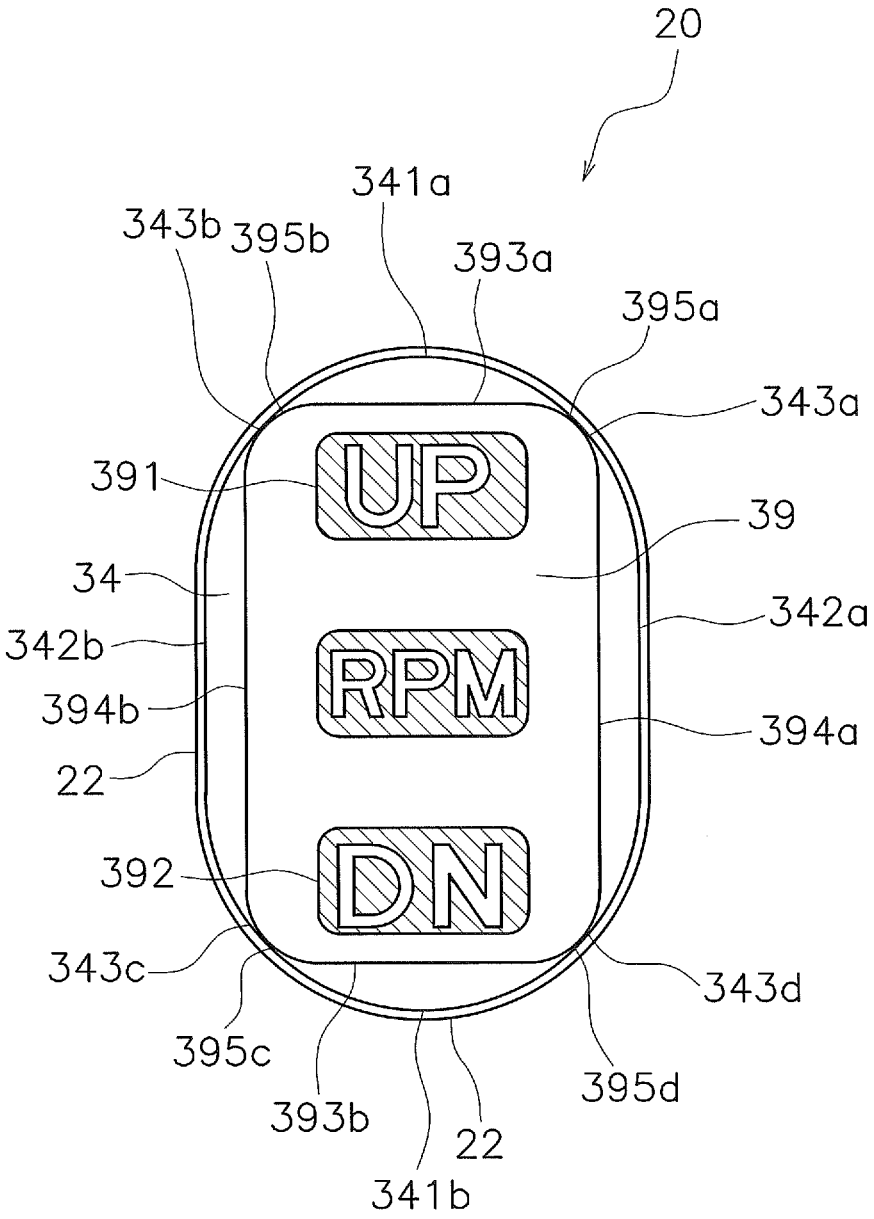
FIG. 15 is a diagram showing a switch assembly according to a fifth modification.

The switch of the present invention is not limited to the PTT switch 21, and may be another type of switch. For example, as shown in a fifth modification of FIG. 15, the switch may be a type of switch for performing operations of increasing and decreasing the engine rotation speed of the outboard motor 1. Further, the construction of the switch is not limited to that described in the aforementioned preferred embodiment. For example, the switch may be a membrane switch.

The object to which the switch is attached is not limited to the lower cover 2*b*, and may be changed. For example, the switch attachment object may be the upper cover 2*a*. Alternatively, the switch attachment object may be other than the engine cover 2. Yet alternatively, the switch attachment object may be other than the outboard motor 1. For example, the switch attachment object may be an operating panel of the hull. Alternatively, the switch attachment object may be a remote controller or a tiller handle to be explained below.

Figure 16:
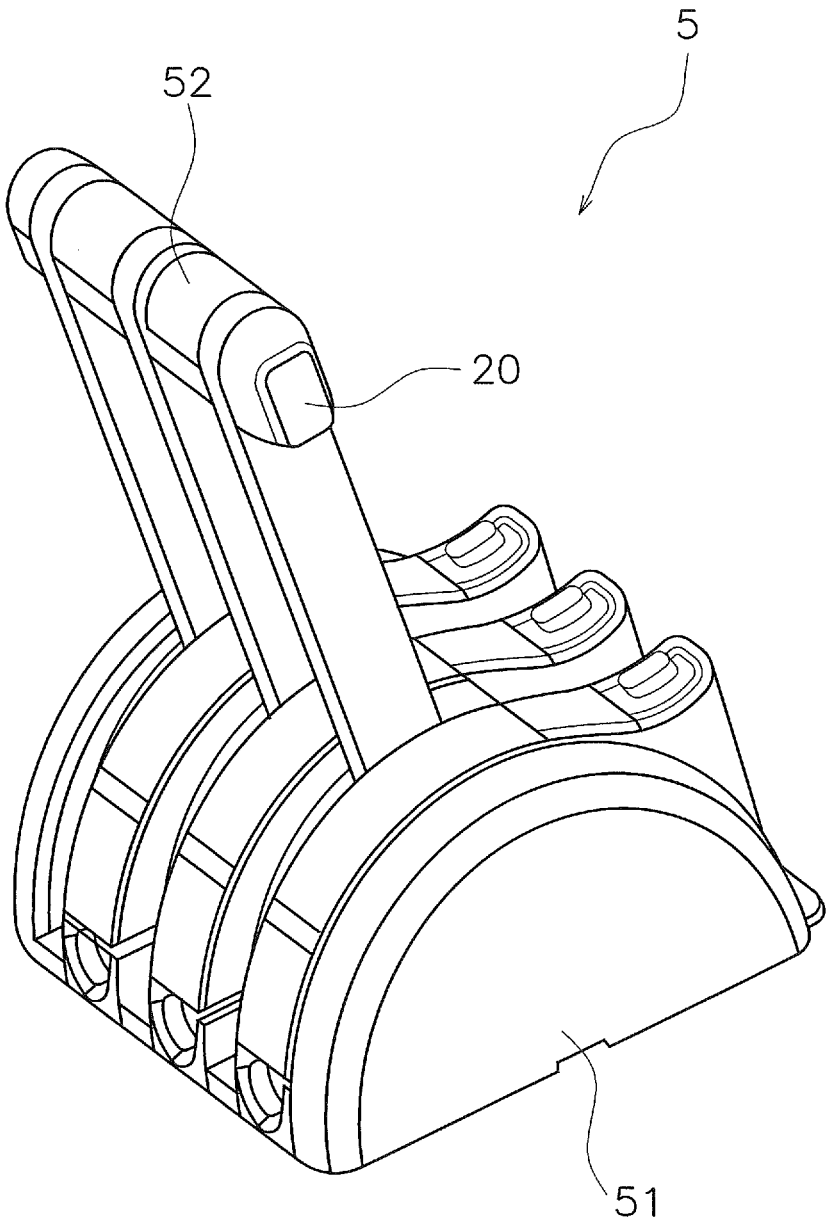
FIG. 16 is a perspective view of a remote controller according to a second preferred embodiment.

FIG. 16 is a perspective view of a remote controller 5 according to a second preferred embodiment. The remote controller 5 is disposed inside the hull to which the outboard motor 1 is attached. For example, the output of the engine 4 of the outboard motor 1 is configured to be regulated by operating the remote controller 5. Further, the rotational direction of the propeller 15 is configured to be switched between a forward thrust direction and a rearward thrust direction by operating the remote controller 5. The remote controller 5 includes a body 51 and a lever portion 52. The lever portion 52 is turnably attached to the body 51. The switch assembly 20 is attached to the lever portion 52. The switch assembly 20 includes the same construction as that of the aforementioned preferred embodiment, and thus, will not be hereinafter explained. It should be noted that the object to which the switch assembly 20 is attached is not limited to the lever portion 52, and may be the body 51.

Figure 17:
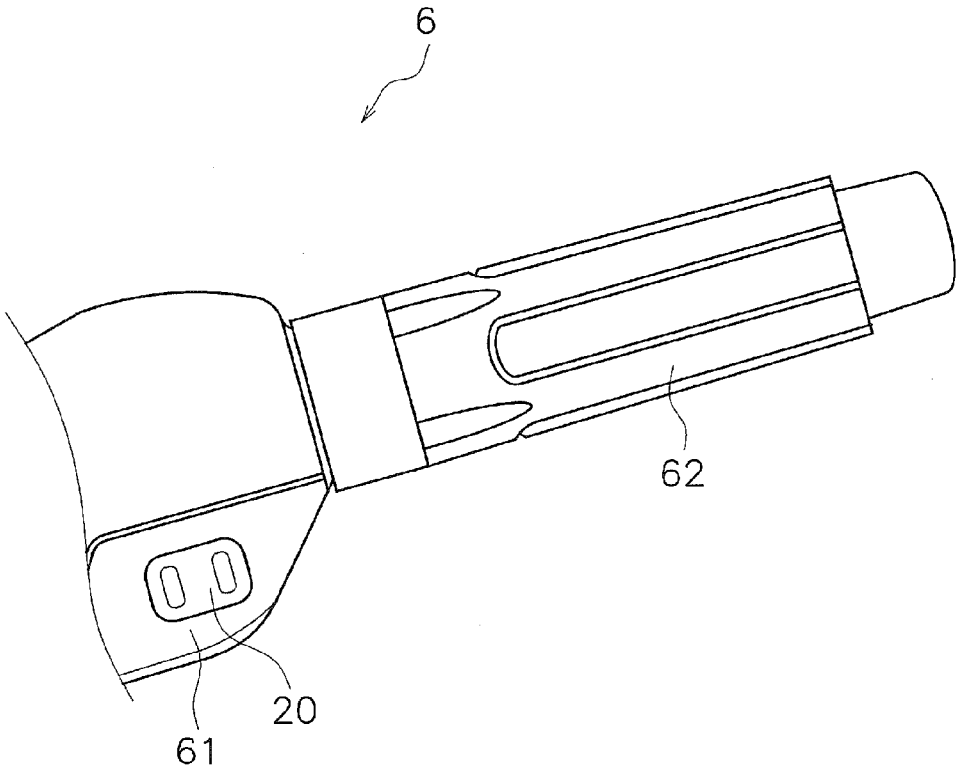
FIG. 17 is a diagram showing a tiller handle according to a third preferred embodiment.

FIG. 17 is a diagram showing a tiller handle 6 according to a third preferred embodiment. The tiller handle 6 is connected to the outboard motor 1. Steering of the hull to which the outboard motor 1 is attached is performed when an operator swings the tiller handle 6 right and left. The tiller handle 6 includes a body 61 and a grip portion 62. The grip portion 62 is attached to the body 61. The switch assembly 20 is attached to the body 61. The switch assembly 20 includes the same construction as that of the aforementioned preferred embodiment, and thus, will not be hereinafter explained. It should be noted that the object to which the switch assembly 20 is attached is not limited to the body 61, and may be the grip portion 62.

The switch may be attached to the attachment object without using a seal member. For example, when the attachment object is disposed in a position that water intrusion is unlikely to occur as with the aforementioned remote controller 5 disposed inside the hull, the PTT switch 21 may be attached to the attachment object without using the seal member 22.

Figure 18:
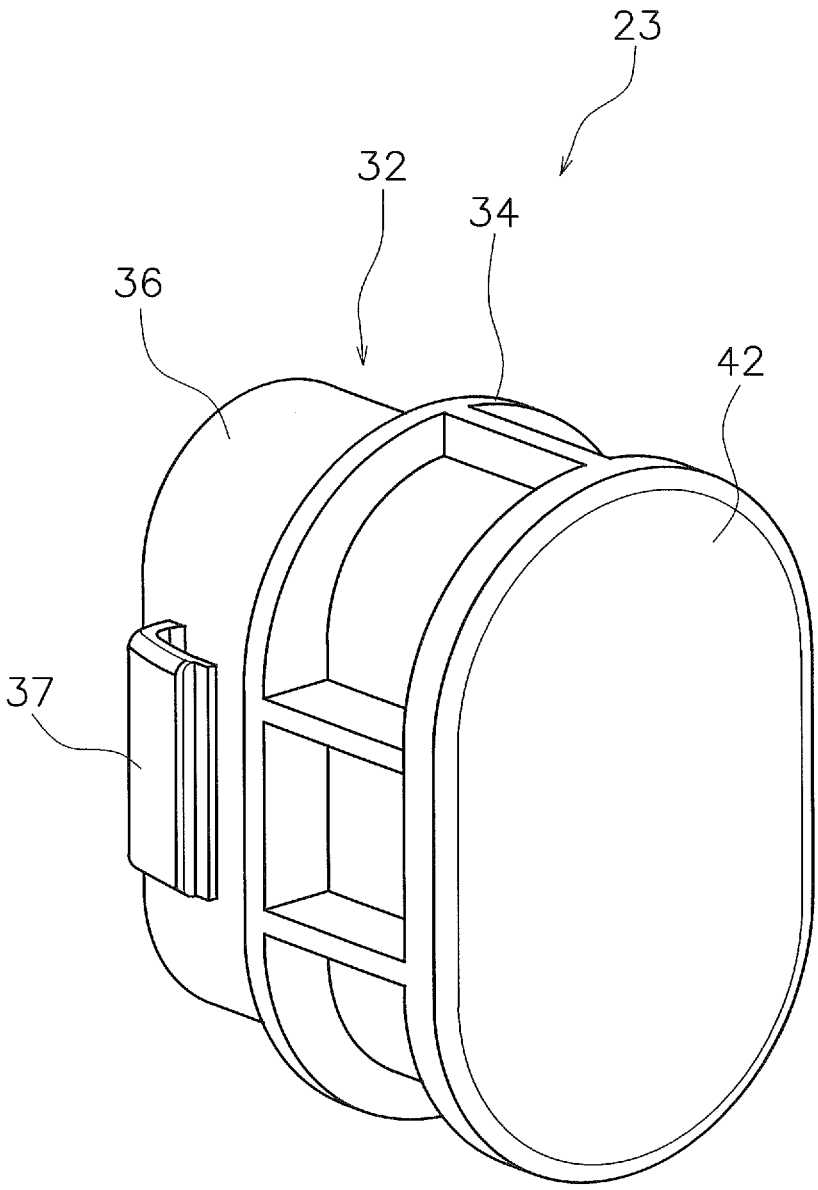
FIG. 18 is a perspective view of a filler plug.

It should be noted that instead of the PTT switch 21, a filler plug 23 shown in FIG. 18 may be attached to the switch attached portion 19. The filler plug 23 includes a plug portion 42 and the attachment member 32. Put differently, the filler plug 23 includes the plug portion 42 instead of the operating portion 31 of the aforementioned PTT switch 21. The plug portion 42 is integrated with the attachment member 32. The attachment member 32 includes the same construction as that of the aforementioned first preferred embodiment, and thus, will not be hereinafter explained. It should be noted that the reference signs, assigned to constituent elements of the PTT switch 21 of the aforementioned preferred embodiment, are similarly assigned to corresponding elements in FIG. 18.

Figure 19:
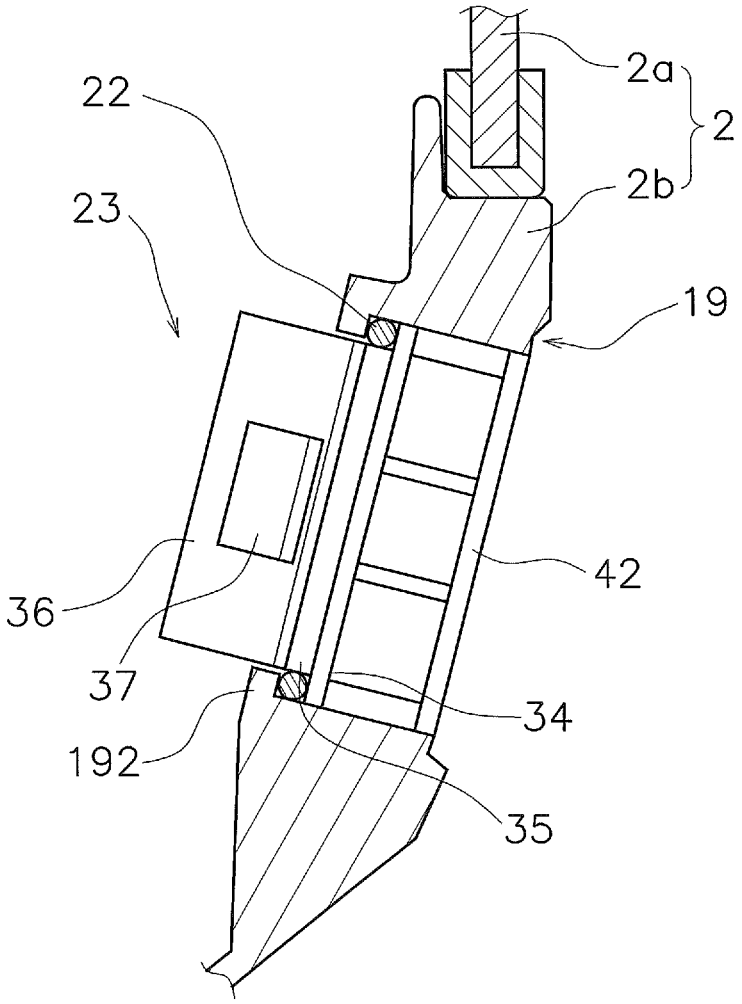
FIG. 19 is a cross-sectional view of a switch seal structure in a condition that the filler plug is attached to the switch attached portion.

FIG. 19 is a cross-sectional view of a switch seal structure for the PTT switch 21 where the filler plug 23 is attached to the switch attached portion 19. As shown in FIG. 19, the plug portion 42 is disposed so as to fill the aperture 191 of the switch attached portion 19. Thus, the aperture 191 of the switch attached portion 19 can be plugged when the PTT switch 21 is not provided. Further, unevenness in the surface of the switch attached portion 19 can be alleviated. Yet further, the attachment object can be compatible for both of the situations that the PTT switch 21 is provided and that the PTT switch 21 is not provided.

What is claimed is:

1. A switch attached to an attachment object through a seal member, comprising:

an operating portion including an operating surface;

a support portion supporting the operating portion so as to enable a push operation for the operating portion;

a flange portion disposed in a direction of the push operation relative to all of the support portion and including a projected area larger than that of the operating portion;

a seal holding portion disposed in the direction of the push operation relative to the flange portion, the seal holding portion having a circular shaped portion or an oval shaped portion in contact with the seal member to hold the seal member with the circular shaped portion or the oval shaped portion; and a pawl portion disposed in the direction of the push operation relative to the seal holding portion and configured to be hooked to the attachment object.

2. The switch according to claim 1, wherein the flange portion has a circular or oval shape.

3. The switch according to claim 2, wherein the operating surface includes a rounded corner, and the rounded corner is at least partially matched with the flange portion in a view from the direction of the push operation so as to border the flange portion in the view.

4. The switch according to claim 3, wherein the operating surface has a circular or oval shape.

5. The switch according to claim 1, wherein the seal holding portion includes the oval shaped portion, the oval shaped portion includes a short side, a long side and a rounded corner, and the rounded corner includes a curvature radius greater than a length of the short side.

6. The switch according to claim 1, wherein the operating surface is movable among a plurality of operating positions based upon the push operation.

7. The switch according to claim 1, wherein the operating surface includes first and second operating positions, the operating surface being movable among the first and second operating positions based upon the push operation, and the operating portion is supported by the support portion so as to be capable of pivoting about a pivot center located between the first operating position and the second operating position.

8. The switch according to claim 1, wherein the switch performs tilt and trim operations of an outboard motor.

9. The switch according to claim 1, wherein the switch performs operations of increasing and decreasing an engine rotation speed of an outboard motor.

10. The switch according to claim 1, wherein the operating portion is movable among a plurality of different operating positions, the operating portion controlling another element so that the another element performs different actions based upon the operating portion being moved into the different operating positions, and the support portion supports the operating portion so as to enable the push operation so that the operating portion moves between the different operating positions in response to a user pushing the operating portion in the direction of the push operation.

11. A switch assembly, comprising:

a seal member; and a switch attached to an attachment object through the seal member, the switch including an operating portion including an operating surface, a support portion supporting the operating portion so as to enable a push operation for the operating portion, a flange portion disposed in a direction of the push operation relative to all of the support portion and including a projected area larger than that of the operating portion, a seal holding portion disposed in the direction of the push operation relative to the flange portion, the seal holding portion including a circular shaped portion or an oval shaped portion in contact with the seal member to hold the seal member with the circular shaped portion or the oval shaped portion, and a pawl portion disposed in the direction of the push operation relative to the seal holding portion and configured to be hooked to the attachment object.

12. The switch assembly according to claim 11, wherein the seal member is an O-ring.

13. The switch assembly according to claim 12, wherein the seal holding portion includes the oval shaped portion, the oval shape of the oval shaped portion includes a rounded corner, and the rounded corner includes a curvature radius greater than or equal to twice a cross-sectional diameter of the seal member.

14. The switch assembly according to claim 12, wherein the seal member outwardly protrudes from the flange portion in a view from the direction of the push operation.

15. The switch assembly according to claim 12, wherein the O-ring is retained by the pawl portion.

16. A switch seal structure, comprising:

a seal member;

an attachment object; and a switch attached to the attachment object through the seal member, the switch including an operating portion including an operating surface, a support portion supporting the operating portion so as to enable a push operation for the operating portion, a flange portion disposed in a direction of the push operation relative to all of the support portion and having a projected area larger than that of the operating portion, a seal holding portion disposed in the direction of the push operation relative to the flange portion, the seal holding portion including a circular shaped portion or an oval shaped portion in contact with the seal member to hold the seal member with the circular shaped portion or the oval shaped portion, and a pawl portion disposed in the direction of the push operation relative to the seal holding portion and configured to be hooked to the attachment object.

17. The switch seal structure according to claim 16, wherein the seal member is disposed between an outer surface of the attachment object and the seal holding portion.

18. The switch seal structure according to claim 16, wherein in a circumferential direction of the seal holding portion, the seal member seals between an outer surface of the attachment object and the seal holding portion.

19. The switch seal structure according to claim 16, wherein the attachment object includes an aperture bored in an outer surface thereof so as to enable the switch to be attached thereto, and the aperture has a circular or oval shape.

20. An outboard motor, comprising:

the switch seal structure according to claim 16.

* * * * *